US008649719B2

(12) United States Patent
Ogihara et al.

(10) Patent No.: US 8,649,719 B2
(45) Date of Patent: Feb. 11, 2014

(54) IMAGE FORMING APPARATUS

(75) Inventors: Atsushi Ogihara, Kanagawa (JP); Shuichi Nishide, Kanagawa (JP); Wataru Suzuki, Kanagawa (JP); Koichi Watanabe, Kanagawa (JP); Tetsuji Okamoto, Kanagawa (JP); Masahiro Sato, Kanagawa (JP); Atsuyuki Kitamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 8 days.

(21) Appl. No.: 13/557,942

(22) Filed: Jul. 25, 2012

(65) Prior Publication Data

US 2013/0223895 A1 Aug. 29, 2013

(30) Foreign Application Priority Data

Feb. 23, 2012 (JP) ..... 2012-037707

(51) Int. Cl.
*G03G 15/01* (2006.01)

(52) U.S. Cl.
USPC ..... 399/303; 399/304

(58) Field of Classification Search
USPC ..... 399/303, 304; 271/275, 277
See application file for complete search history.

(56) References Cited

FOREIGN PATENT DOCUMENTS

JP 04-125666 A 4/1992
JP 04-315163 A 11/1992

*Primary Examiner* — Walter L Lindsay, Jr.
*Assistant Examiner* — Barnabas Fekete
(74) *Attorney, Agent, or Firm* — Sughrue Mion, PLLC

(57) ABSTRACT

In an image forming apparatus, the following inequalities (1) and (2) are satisfied:

$$(L1-L3)\times(V2/V1)<L2 \quad (1)$$

$$L2<(L1-L3+L4)\times(V2/V1) \quad (2)$$

where L1 denotes a peripheral length of an image carrier from an exposure position to a transfer position, L2 denotes a peripheral length of a transfer member from a gripping position to the transfer position, L3 denotes a length of a leading-end margin, L4 denotes a peripheral length of the transfer member, when recording media having a maximum transportable size are wrapped around the transfer member, between a trailing end of an image region of the first recording medium and a leading end of an image region of the second recording medium, V1 denotes a peripheral velocity of the image carrier, and V2 denotes a peripheral velocity of the transfer member.

4 Claims, 11 Drawing Sheets

FIG. 3

| | |
|---|---|
| OUTER DIAMETER AND OUTER PERIPHERAL LENGTH OF IMAGE CARRIER | $\phi$30 mm, 94.2 mm |
| PERIPHERAL LENGTH FROM EXPOSURE POSITION Ro TO TRANSFER POSITION Tr: L1 | 47.1 mm |
| OUTER DIAMETER AND OUTER PERIPHERAL LENGTH OF TRANSFER DRUM | $\phi$119.4 mm, 375.1 mm |
| PERIPHERAL LENGTH FROM GRIPPING POSITION Pa TO TRANSFER POSITION Tr: L2 | 55 mm |
| LONGITUDINAL LENGTH OF MAXIMUM SHEET SIZE | 355.6 mm (LEGAL SIZE) |
| LENGTH OF LEADING-END MARGIN OF SHEET MEDIUM P: L3 | 3 mm |
| INTER-IMAGE DISTANCE: L4 | 25.5 mm |

IMAGE FORMING APPARATUS

CROSS-REFERENCE TO RELATED APPLICATIONS

This application is based on and claims priority under 35 USC 119 from Japanese Patent Application No. 2012-037707 filed Feb. 23, 2012.

BACKGROUND

The present invention relates to an image forming apparatus.

SUMMARY

An image forming apparatus according to an aspect of the present invention includes an image carrier, a surface of which is charged while the image carrier is rotating, an exposing device that faces the image carrier at an exposure position and emits light toward the image carrier to form an electrostatic latent image on the charged surface of the image carrier, a developing member that develops the electrostatic latent image formed on the surface of the image carrier into a toner image, a transfer member that, while rotating, transports a recording medium to a transfer position, at which the transfer member faces the image carrier, and that transfers the toner image formed on the surface of the image carrier to the recording medium, the recording medium being wrapped around an outer peripheral surface of the transfer member, and a gripping member that is disposed on the transfer member, the gripping member gripping a leading end portion of the recording medium having been transported to the rotating transfer member at a gripping position. In the image forming apparatus, the following inequalities (1) and (2) are satisfied:

$$(L1-L3)\times(V2/V1)<L2 \quad (1)$$

$$L2<(L1-L3+L4)\times(V2/V1) \quad (2)$$

Here, L1 denotes a peripheral length of the image carrier from the exposure position to the transfer position in a rotating direction of the image carrier. L2 denotes a peripheral length of the transfer member from the gripping position to the transfer position in the rotating direction of the transfer member. L3 denotes a length of a margin on a leading-end side of the recording medium in which no toner image is formed. L4 denotes a peripheral length of the transfer member, when a first recording medium and a second recording medium having a maximum size transportable by the transfer member are wrapped around the transfer member, between a trailing end of an image region of the first recording medium and a leading end of an image region of the second recording medium, the image regions of the recording media each being a region over the entire area of which an image is formable, the first recording medium being positioned on a side that is further upstream than the second recording medium in the rotating direction of the transfer member. V1 denotes a peripheral velocity of the image carrier. V2 denotes a peripheral velocity of the transfer member.

BRIEF DESCRIPTION OF THE DRAWINGS

An exemplary embodiment of the present invention will be described in detail based on the following figures, wherein:

FIG. 3 is a table illustrating dimensions or other properties of the transfer drum and the image carrier of the image forming apparatus according to the exemplary embodiment;

DETAILED DESCRIPTION

Figure 1:
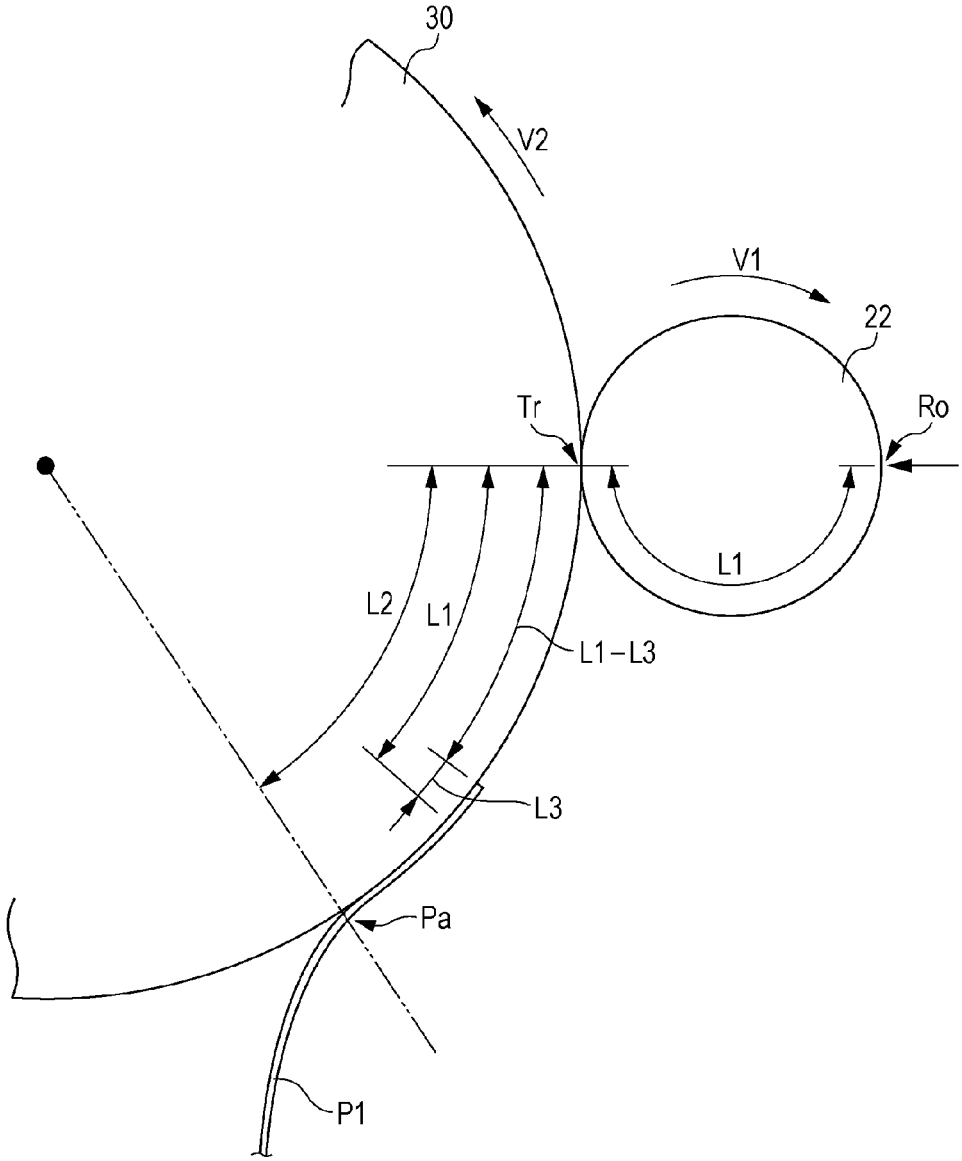
FIG. 1 is a schematic diagram illustrating the vicinity of a position at which a transfer drum and an image carrier of an image forming apparatus according to an exemplary embodiment perform nipping.

An image forming apparatus 10 according to an exemplary embodiment of the present invention will be described referring to FIGS. 1 to 11. The arrow UP illustrated in the drawings denotes a vertically upward direction.

Entire Configuration

Figure 11:
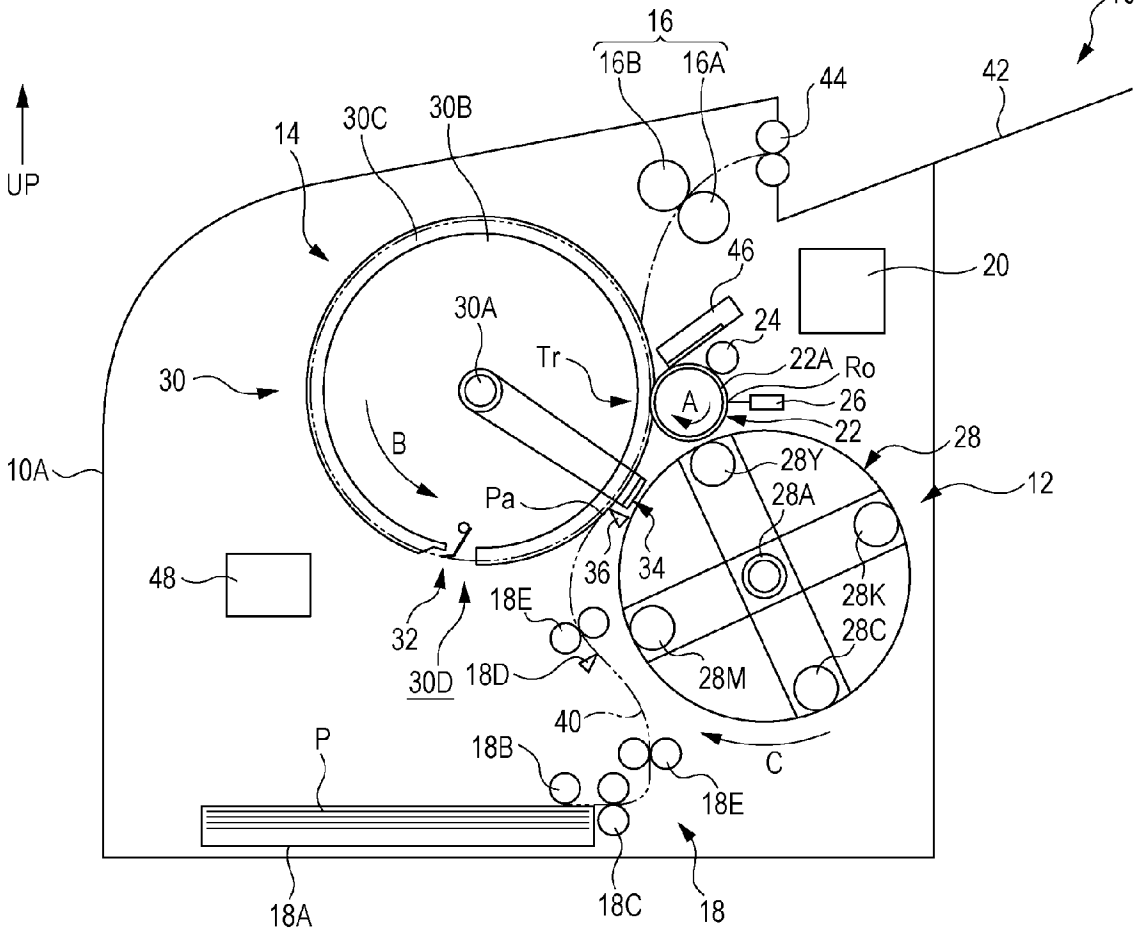
FIG. 11 schematically illustrates the image forming apparatus according to the exemplary embodiment.

As illustrated in FIG. 11, the image forming apparatus 10 according to the exemplary embodiment of the present invention includes an image forming unit 12, a transfer device 14, a fixing device 16, a sheet feeding unit 18, and a controlling unit 20. The image forming unit 12 forms a toner image. A sheet medium P is a recording medium and is fed to the transfer device 14, and the transfer device 14 transfers the toner image, having been formed thereon by the image forming unit 12, to the sheet medium P that is wrapped around the transfer device 14. The fixing device 16 fixes the toner image, having been formed on the sheet medium P released from the transfer device 14, onto the sheet medium P. The sheet feeding unit 18 feeds the sheet medium P to the transfer device 14. The controlling unit 20 controls the entirety of the image forming apparatus 10.

Image Forming Unit

The image forming unit 12 that forms a toner image will be described first.

The image forming unit 12 includes an image carrier 22, on whose surface toner images are sequentially formed while the image carrier 22 is rotating. The image forming unit 12 also includes a charging device 24, an exposing device 26, a rotary developing device 28, and a cleaning device 46. The charging device 24 charges the surface of the image carrier 22. The exposing device 26 exposes the charged surface of the image carrier 22 to light to form an electrostatic latent image. The rotary developing device 28 develops the electrostatic latent image, having been formed on the surface of the image carrier 22, by using a developer into a toner image. The cleaning device 46 cleans remnants remaining on the image carrier 22.

Image Carrier

The image carrier 22 is disposed so as to rotate in the arrow A direction and includes a negatively charged photosensitive layer 22A on the surface. The outer diameter of the image carrier 22 is 30 mm, for example. The charging device 24, the exposing device 26, the rotary developing device 28, and the cleaning device 46 are arranged around the image carrier 22 in this order in the arrow A direction. A driving source (not illustrated) that drives the image carrier 22 to rotate at a peripheral velocity V1 is also provided.

Charging Device

The charging device 24 is a roller-type charging device that is arranged so as to face the image carrier 22. While the charging device 24 is driven to rotate by the rotating image carrier 22, the charging device 24 charges the surface of the image carrier 22 by applying a charging bias to the surface from a charging-bias power source, which is not illustrated.

Exposing Device

The exposing device 26 irradiates the surface of the image carrier 22 having been charged by the charging device 24 with light to form an electrostatic latent image. In this exemplary embodiment, the exposing device 26 includes, for example, multiple light emitting diodes (LEDs, which are not illustrated).

Rotary Developing Device

The rotary developing device 28 includes a rotation shaft 28A and developing members 28Y, 28M, 28C, and 28K for yellow (Y), magenta (M), cyan (C), and black (K) arranged around the rotation shaft 28A. The rotary developing device 28 rotates in the arrow C direction around the rotation shaft 28A.

In the rotary developing device 28, each of the developing members 28Y, 28M, 28C, and 28K is positioned at a position opposite the image carrier 22. The rotary developing device 28 then applies a developing bias from a developing bias power source, which is not illustrated, to each electrostatic latent image on the image carrier 22 having been formed by the exposing device 26 in order to sequentially develop the electrostatic latent images into toner images of the different colors.

These developing members 28Y, 28M, 28C, and 28K contain developers of corresponding colors.

Cleaning Device

The cleaning device 46 recovers toner remaining on the surface of the image carrier 22 without being transferred to the sheet medium P by the transfer device 14, which will be described below, or other extraneous matters from the surface of the image carrier 22. The cleaning device 46 according to the exemplary embodiment is a blade-type cleaner.

Transfer Device

Now, description will be given on the transfer device 14 around which a sheet medium P is wrapped and that transfers a toner image having been formed thereon by the image forming unit 12 to the wrapped sheet medium P.

The transfer device 14 includes a transfer drum 30, a leading-end gripper 32, and a trailing-end gripper 34. The transfer drum 30 is taken as an example of a transfer member around which a sheet medium P, to which a toner image on the image carrier 22 is transferred, is wrapped. The leading-end gripper 32 is taken as an example of a leading-end gripping member that grips a leading end portion of the sheet medium P that is wrapped around the transfer drum 30. The trailing-end gripper 34 is taken as an example of a trailing-end controlling member that controls the position of a trailing end portion of the sheet medium P.

The transfer device 14 also includes a sheet sensor 36 that detects a sheet medium P passing thereby, a driving motor M1 (see FIGS. 7A and 7B) that drives the transfer drum 30 to rotate, and a power source 48 that applies a transfer bias, which is a voltage of a polarity opposite to that of the toner, to the transfer drum 30.

Transfer Drum

The transfer drum 30 arranged so as to face the image carrier 22 includes a rotation shaft 30A, a drum-shaped base portion 30B, and an elastically deformable elastic layer 30C that is formed around the outer peripheral surface of the base portion 30B. The outer diameter of the transfer drum is 119.4 mm, for example.

The elastic layer 30C, from a leading end to a trailing end of the elastic layer 30C in a direction in which the sheet medium P is transported, contiguously lies on the outer periphery of the drum-shaped base portion 30B. A portion of the transfer drum 30, around which even a maximum-size sheet medium P is not wrapped, is a cutout region 30D in which the elastic layer 30C is absent such that a part of the periphery of the elastic layer 30C is cut out.

The dimensions of the components and the positional relationships between the components are determined such that the transfer drum 30 and the image carrier 22 do not contact each other when the cutout region 30D of the transfer drum 30 faces the image carrier 22. A dielectric substance, such as a dielectric sheet, is not attached to the outer peripheral surface of the elastic layer 30C, and thus wrapping of a sheet medium P around the transfer drum 30 does not involve the use of electrostatic attraction.

Figure 10:
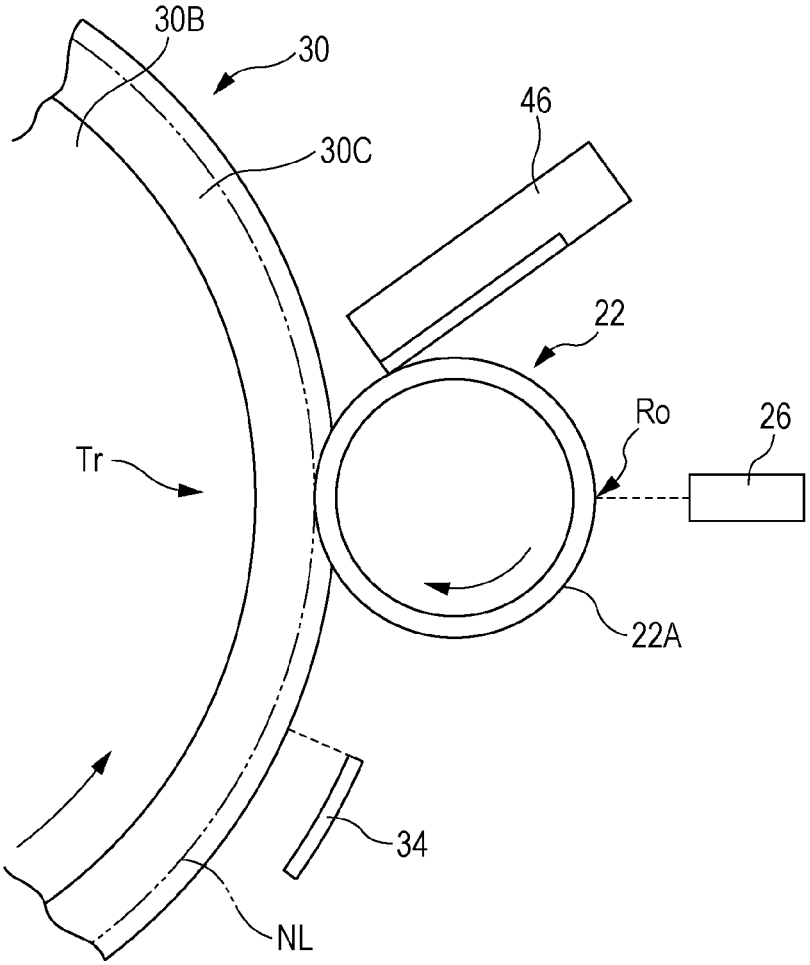
FIG. 10 schematically illustrates the surroundings of a transfer position Tr of the image forming apparatus according to the exemplary embodiment.

As illustrated in FIG. 10, at a transfer position Tr at which the transfer drum 30 and the image carrier 22 face each other to transfer a toner image to the sheet medium P, the elastic layer 30C of the transfer drum 30 is pressed by the image carrier 22. The elastic layer 30C is then pressed by the image carrier 22 down to a compressed circumference NL illustrated in FIG. 10 with the two-dot chain line.

At the transfer position Tr, transporting of the sheet medium P that is nipped by the transfer drum 30 and the image carrier 22 is performed dominantly by using electrostatic attraction of the image carrier 22.

Figure 7A:
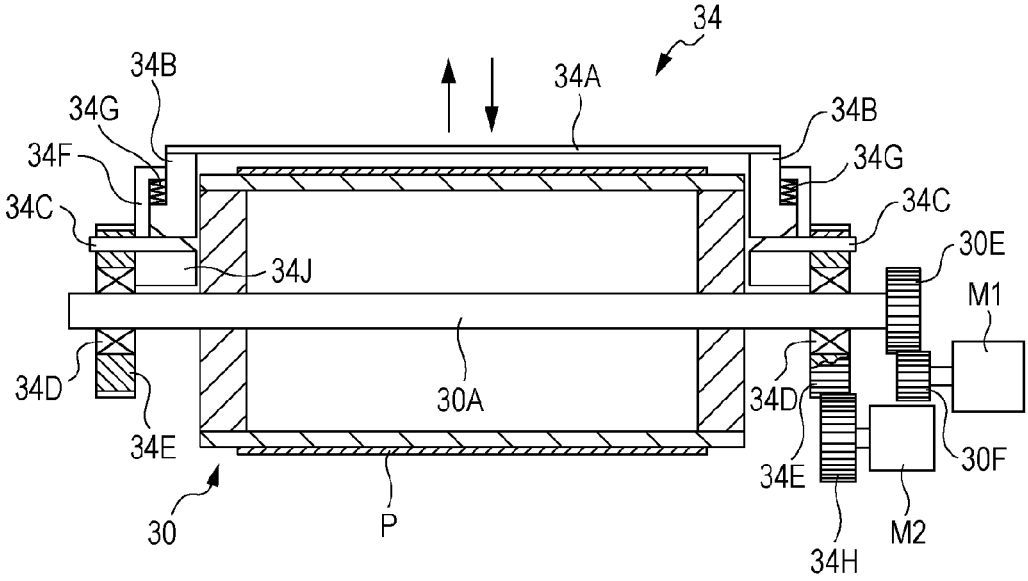
FIGS. 7A and 7B schematically illustrate the configuration of the transfer drum and the trailing-end gripper of the image forming apparatus according to the exemplary embodiment.
Figure 7B:
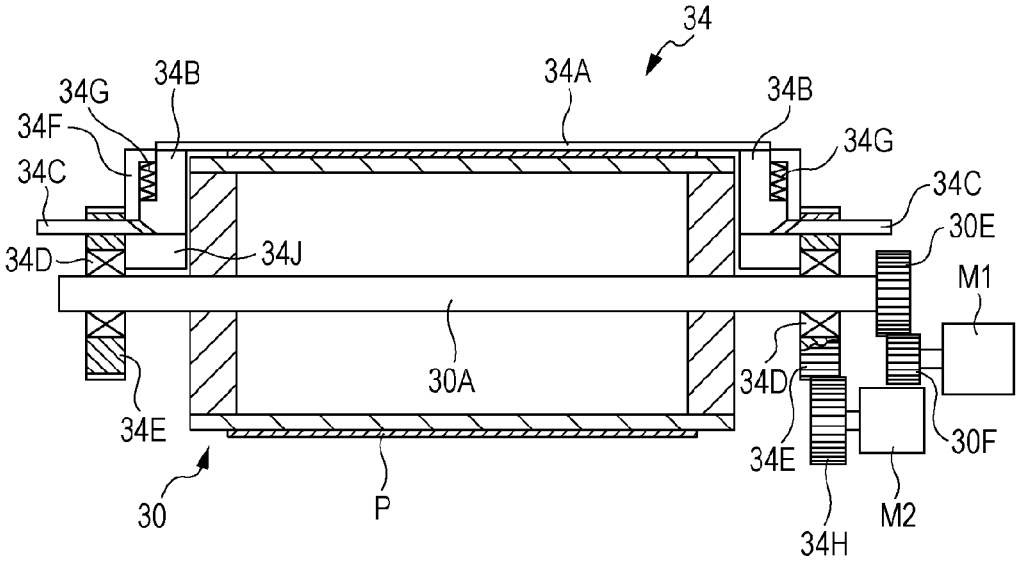

As illustrated in FIGS. 7A and 7B, a gear 30E is mounted on an end portion of the rotation shaft 30A of the transfer drum 30 and engages with a gear 30F mounted on an output shaft of the driving motor M1, which drives the transfer drum 30 to rotate. The transfer drum 30 is driven to rotate by the driving force of the driving motor M1 at a peripheral velocity V2, which is lower than a peripheral velocity V1 of the image carrier 22.

Sheet Sensor

As illustrated in FIG. 11, the sheet sensor 36 is arranged so as to face the outer peripheral surface of the transfer drum 30. The sheet sensor 36 irradiates the sheet medium P, which is transported while being wrapped around the transfer drum 30, with infrared light, and detects the sheet medium P passing thereby using the reflected light.

The sheet sensor 36 is disposed on a side that is further upstream, in the direction in which the sheet medium P is transported, than a stand-by position of the trailing-end gripper 34 (the position of the trailing-end gripper 34 illustrated in FIG. 11), which will be described below, and on a side that is further downstream, in the direction in which the sheet medium P is transported, than a feeding-sheet position Pa at which a sheet medium P is fed to the transfer drum 30. Since a leading end portion of a sheet medium P is gripped by the leading-end gripper 32 at the feeding-sheet position Pa, the feeding-sheet position Pa is also referred to as a gripping position Pa.

Leading-End Gripper

Figure 5A:
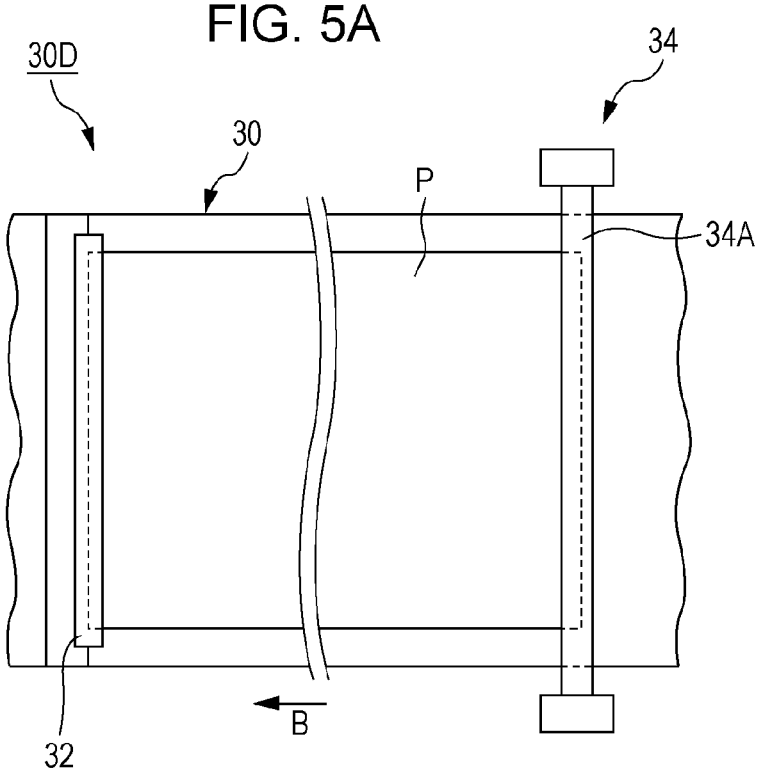
FIGS. 5A and 5B illustrate the transfer drum, the leading-end gripper, and a trailing-end gripper of the image forming apparatus according to the exemplary embodiment when viewed in plan and from a side.
Figure 5B:
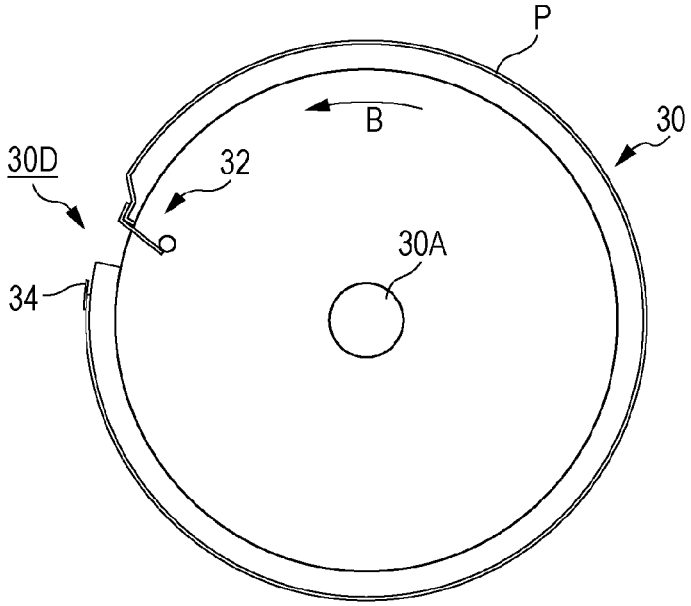

As illustrated in FIGS. 5A and 5B, the leading-end gripper 32 that grips the leading end portion of the sheet medium P wrapped around the transfer drum 30 is attached to the transfer drum 30, and is disposed in the cutout region 30D. FIG. 5A is a development drawing in which the outer periphery of the transfer drum 30 is developed.

Figure 4A:
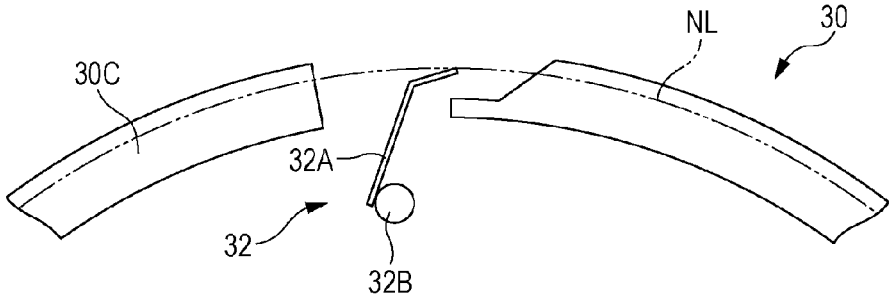
FIGS. 4A and 4B illustrate a leading-end gripper of the image forming apparatus according to the exemplary embodiment that is positioned in a releasing state and in a gripping state, when viewed from a side.
Figure 4B:
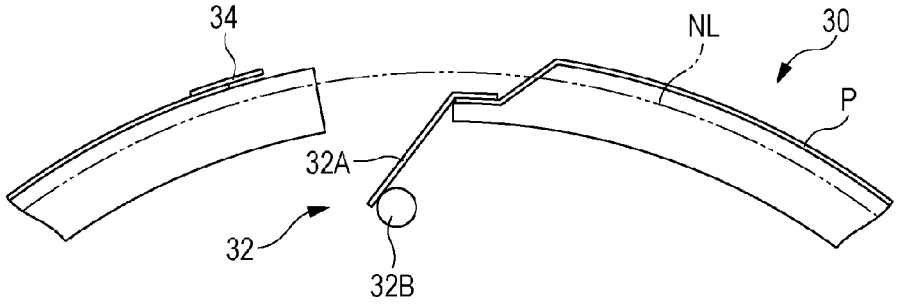

As illustrated in FIGS. 4A and 4B, the leading-end gripper 32 includes a pressing plate 32A and a shaft member 32B. The pressing plate 32A presses the leading end portion of the sheet medium P against the elastic layer 30C. The shaft member 32B causes the pressing plate 32A to rotate such that a leading end portion of the sheet medium P is griped or released.

The pressing plate 32A extends in a direction of a rotation axis of the transfer drum 30 (or may simply be referred to as a "drum axis direction", below). For example, the pressing plate 32A is formed by bending a stainless steel plate, and has a single bent portion when viewed in the drum axis direction.

An axis direction of the shaft member 32B is along the drum axis direction. The shaft member 32B, which is cylindrical, is secured to a first end portion of the pressing plate 32A. Accordingly, when the shaft member 32B is rotated, the leading-end gripper 32 moves so as to switch between a gripping state, in which a second end portion of the pressing plate 32A grips the leading end portion of the sheet medium P (see FIG. 4B), and a releasing state, in which the second end portion releases the leading end portion of the sheet medium P (see FIG. 4A).

As illustrated in FIGS. 4A and 4B, a locus of the leading-end gripper 32 that moves so as to switch between the gripping state and the releasing state is formed on the inner side of the compressed circumference NL, and thus the leading-end gripper 32 does not contact the image carrier 22. In other words, the leading-end gripper 32 is located outside a region within which the image carrier 22 compresses the elastic layer 30C, and thus when the leading-end gripper 32 has been moved to the transfer position Tr, the leading-end gripper 32 is separated from the image carrier 22.

Trailing-End Gripper

As illustrated in FIGS. 5A and 5B, the trailing-end gripper 34 is stretched across the transfer drum 30 in the drum axis direction, and rotates around the rotation shaft 30A independently of the transfer drum 30.

As illustrated in FIGS. 7A and 7B, the trailing-end gripper 34 includes a sheet controlling portion 34A extending in the drum axis direction, and holding portions 34B that hold both end portions of the sheet controlling portion 34A. The sheet controlling portion 34A stops the trailing end portion of the sheet medium P from moving.

The sheet controlling portion 34A is made of a film-formed resin material and is elastically deformable. Examples of the resin material include polyethylene terephthalate (PET), polyimide, and fluorocarbon resins.

The holding portions 34B extend in the radial direction of the transfer drum 30 (also simply referred to as a "drum radial direction", below). The trailing-end gripper 34 also includes wedge-shaped shifting members 34C, whose movement in the drum axis direction causes the sheet controlling portion 34A to move in the drum radial direction via the holding portions 34B.

Figure 6A:
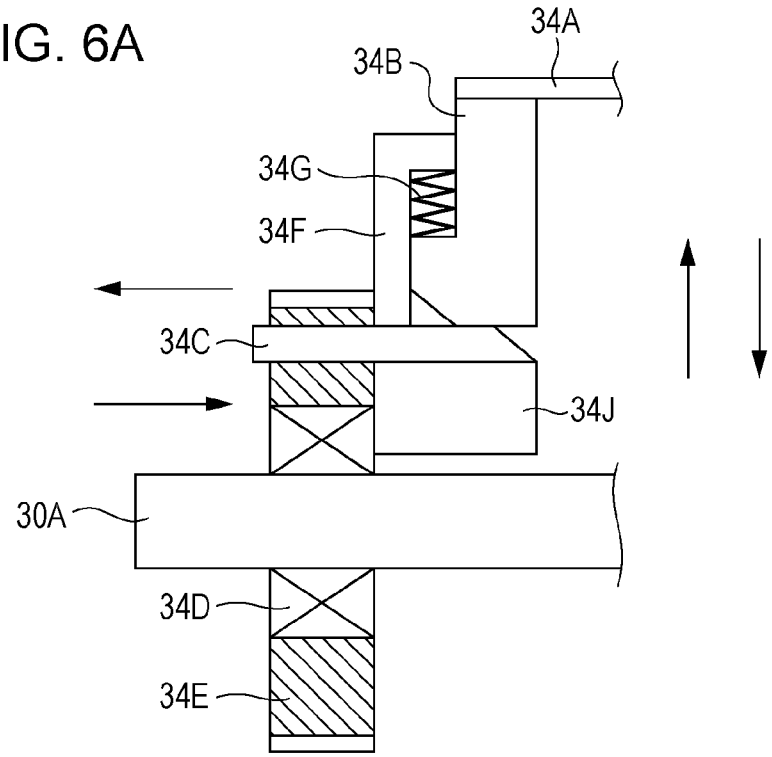
FIGS. 6A and 6B schematically illustrate the configuration of the trailing-end gripper of the image forming apparatus according to the exemplary embodiment.
Figure 6B:
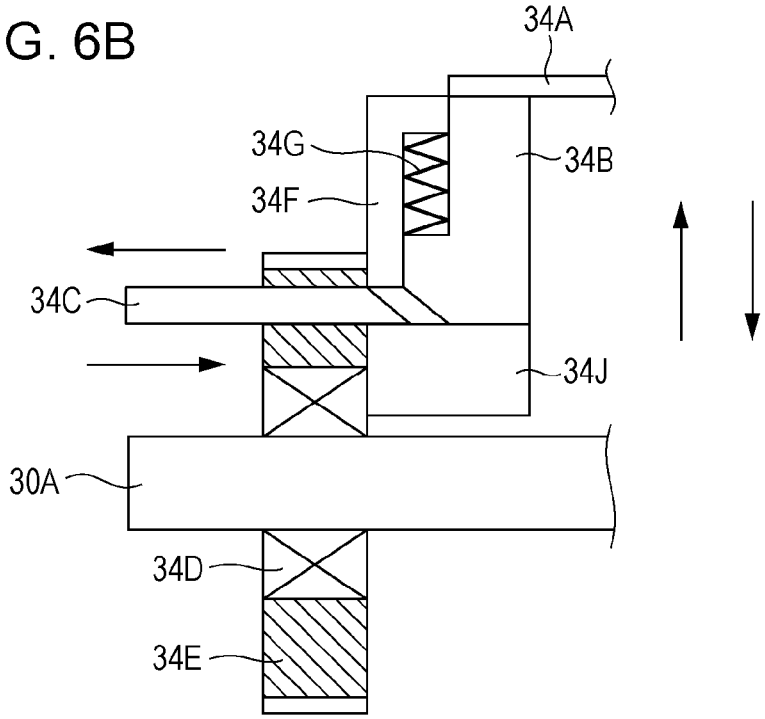

As illustrated in FIGS. 6A and 6B, gears 34E are attached to the rotation shaft 30A via bearings 34D, and supporting portions 34F extending in the drum radial direction are attached to the gears 34E. Each holding portion 34B is disposed so as to be movable with respect to a corresponding one of the supporting portions 34F in the drum radial direction. A spring member 34G is interposed between each holding portion 34B and a corresponding supporting portion 34F, the spring member 34G urging the holding portion 34B in a radially inward direction. The trailing end gripper 34 also includes stopper portions 34J that control the positions of the holding portions 34B when being contacted by the holding portions 34B having been urged by the spring members 34G in the radially inward direction.

In this configuration, when the controlling unit 20 controls a solenoid, which is not illustrated, to move the wedge-shaped shifting members 34C in the drum axis direction and insert each of the wedge-shaped shifting members 34C between one of the holding portions 34B and a corresponding stopper portion 34J, the holding portions 34B are moved in a radially outward direction. With this operation, the sheet controlling portion 34A switches to the releasing state, in which the sheet controlling portion 34A becomes separated from the elastic layer 30C to release the trailing end portion of the sheet medium P (see FIGS. 6A and 7A).

On the other hand, when the controlling unit 20 controls a solenoid, which is not illustrated, to move the wedge-shaped shifting members 34C in the drum axis direction and pull out each of the wedge-shaped shifting members 34C from between one of the holding portions 34B and a corresponding stopper portion 34J, the holding portions 34B are moved in a radially inward direction. With this operation, the sheet controlling portion 34A switches to the controlling state in which the sheet controlling portion 34A brings the sheet medium P into contact with the elastic layer 30C such that the sheet medium P contiguously lies on the elastic layer 30C (see FIGS. 6B and 7B).

As illustrated in FIGS. 7A and 7B, a driving motor M2 that drives the trailing-end gripper 34 to rotate around the rotation shaft 30A is provided, and a gear 34H that is mounted on an output shaft of the driving motor M2 engages with one of the gears 34E.

As described above, since the trailing-end gripper 34 is disposed as a body that is separate from the transfer drum 30, the position of the trailing-end gripper 34 is changeable with respect to the transfer drum 30.

When the leading-end gripper 32 grips the leading end portion of the sheet medium P, the leading-end gripper 32 does not allow the sheet medium P to move in the transporting direction and stops the sheet medium P from being separated from the transfer drum 30. On the other hand, when the trailing-end gripper 34 controls the trailing end portion of the sheet medium P, the trailing-end gripper 34 allows the sheet medium P to move in the transporting direction but stops the sheet medium P from being separated from the transfer drum 30.

Fixing Device

The fixing device 16 that fixes a toner image formed on a sheet medium P onto the sheet medium P will be described now.

As illustrated in FIG. 11, the fixing device 16 includes a heating roller 16A and a pressurizing roller 16B. The heating roller 16A includes a heating source (not illustrated) and a rotating force is transmitted to the heating roller 16A. The pressurizing roller 16B is in contact with the heating roller 16A with pressure.

When a sheet medium P holding a toner image is nipped between and transported by the heating roller 16A and the pressurizing roller 16B, the toner image is melted and pressurized and is thus fixed onto the sheet medium P.

Discharging rollers 44 are disposed on a side that is further downstream than the fixing device 16 in the direction in which the sheet medium P is transported. The discharging rollers 44 discharge the sheet medium P, having a toner image fixed thereon, to a discharge portion 42 formed on an upper surface of an apparatus body 10A.

Sheet Feeding Unit

Now, the sheet feeding unit 18 that feeds a sheet medium P to the transfer device 14 will be described.

The sheet feeding unit 18 is disposed at a lower portion in the apparatus body 10A of the image forming apparatus 10 and includes a sheet containing member 18A, a pick-up roller 18B, separation rollers 18C, and a leading-end sensor 18D. The sheet containing member 18A contains sheet media P. The pick-up roller 18B picks up the sheet media P from the sheet containing member 18A. The separation rollers 18C separate closely attached sheet media P from each other. The leading-end sensor 18D detects the leading end portion of a sheet medium P passing thereby.

The sheet feeding unit 18 also includes multiple transporting rollers 18E. Each sheet medium P is transported by the transporting rollers 18E along a transport path 40.

In this manner, each sheet medium P is transported along the transport path 40 from the sheet containing member 18A to the feeding-sheet position Pa, which is positioned on a side that is further upstream than the transfer position Tr in the direction of rotation of the transfer drum 30.

Operations of Entire Configuration

Now, operations of the entire configuration will be described.

Firstly, color image data that has been formed by a personal computer or the like, which is not illustrated, is input to an image signal processor (not illustrated) as red (R), green (G), and blue (B) data, for example, and is then subjected to image processing. The image data that has been subjected to image processing is converted into four-color gradation data for yellow (Y), magenta (M), cyan (C), and black (K), which is output to the exposing device 26, so that an image forming operation is started.

With the start of the image forming operation, the image carrier 22 and the transfer drum 30 start rotating together. Here, the peripheral velocity V1 of the image carrier 22 is higher than the peripheral velocity V2 of the transfer drum 30. For example, the peripheral velocity V1 of the image carrier 22 is approximately 0.5% to 1% higher than the peripheral velocity V2 of the transfer drum 30.

At this time, the leading-end gripper 32 and the trailing-end gripper 34 are in the releasing state.

While the leading-end gripper 32 rotates together with the transfer drum 30, the trailing-end gripper 34 remains stationary at the stand-by position without rotating together with the transfer drum 30.

The photosensitive layer 22A of the rotating image carrier 22 is charged by the charging device 24. The exposing device 26 then irradiates the image carrier 22 with light so that an electrostatic latent image for a first color (yellow, for example) based on the image information is formed on the image carrier 22.

Meanwhile, the rotary developing device 28 rotates so that a developing member containing a toner of the color corresponding to the electrostatic latent image to be formed on the image carrier 22 (the yellow developing member 28Y, if the corresponding color is yellow) is positioned at a position opposite the image carrier 22.

Thereafter, the developing member 28Y develops the electrostatic latent image on the image carrier 22 to form a toner image on the image carrier 22. This toner image is transported toward the transfer position Tr, at which the toner image faces the transfer drum 30, with the rotation of the image carrier 22.

With the start of the image forming operation, feeding of a sheet medium P is also started. Specifically, sheet media P that are picked up from the sheet containing member 18A by the pick-up roller 18B are separated by the separation rollers 18C. The separated sheet media P are forwarded to the transport path 40 by the transporting rollers 18E. The leading-end sensor 18D then detects the leading end portion of each sheet medium P passing thereby and transmits a detection signal to the controlling unit 20.

Figure 8A:
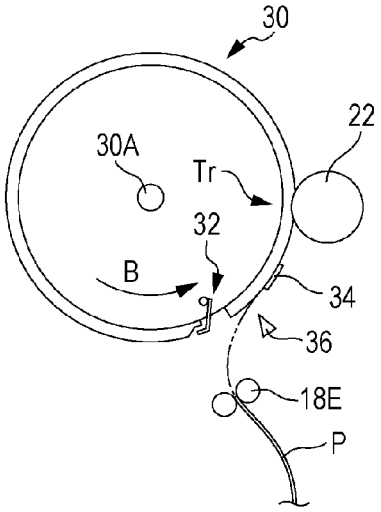
FIGS. 8A, 8B, 8C, and 8D illustrate a series of states in which a sheet medium P is wrapped around the transfer drum of the image forming apparatus according to the exemplary embodiment.

The controlling unit 20 that has received the detection signal controls transportation of the sheet medium P on the basis of the detection signal such that the sheet medium P arrives at the feeding-sheet position Pa at the same time as when the leading-end gripper 32 arrives at the feeding-sheet position Pa (see FIG. 8A).

Here, at the time of feeding the sheet medium P, information on the size of the sheet medium P that has been detected by a sheet-size sensor (not illustrated) is transmitted to the controlling unit 20.

Figure 8B:
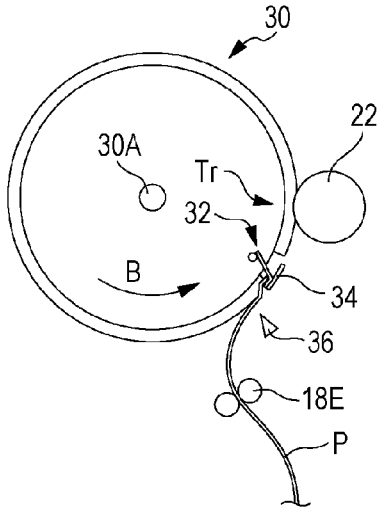

As illustrated in FIG. 8B, the leading-end gripper 32 that has been in the releasing state switches to the gripping state at the same time as when the leading end portion of the sheet medium P arrives at the feeding-sheet position Pa. The leading end portion of the sheet medium P is thus gripped by the leading-end gripper 32.

The leading-end gripper 32 gripping the sheet medium P then passes a position opposite the stationary trailing-end gripper 34. The leading-end gripper 32 having passed the trailing-end gripper 34 then moves toward the transfer position Tr while gripping the sheet medium P.

Figure 8C:
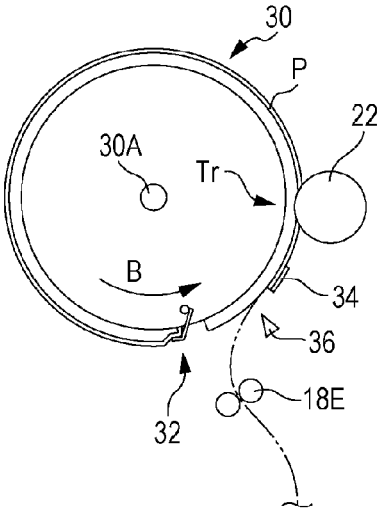

The sheet medium P that has passed the transfer position Tr while being gripped by the leading-end gripper 32 is consequently wrapped around the transfer drum 30 while being gripped by the leading-end gripper 32, as illustrated in FIG. 8C.

The toner image of the first color (yellow, for example) formed on the image carrier 22 is transferred to the sheet medium P on the transfer drum 30 at the transfer position Tr at which the image carrier 22 and the transfer drum 30 face each other. Part of toner remaining on the image carrier 22 after the transfer is recovered from the image carrier 22 by the cleaning device 46 (see FIG. 10).

Thereafter, the sheet sensor 36 detects the trailing end portion of the sheet medium P passing thereby. The controlling unit 20 that has received a signal from the sheet sensor 36 sends an instruction to the trailing-end gripper 34.

The trailing-end gripper 34 having received the instruction switches from the releasing state to the controlling state to control the trailing end portion of the sheet medium P. The trailing-end gripper 34 that has switched to the controlling state starts rotating together with the transfer drum 30. In other words, the sheet controlling portion 34A of the trailing-end gripper 34 moves at the same velocity as the peripheral velocity V2 of the transfer drum 30.

Figure 8D:
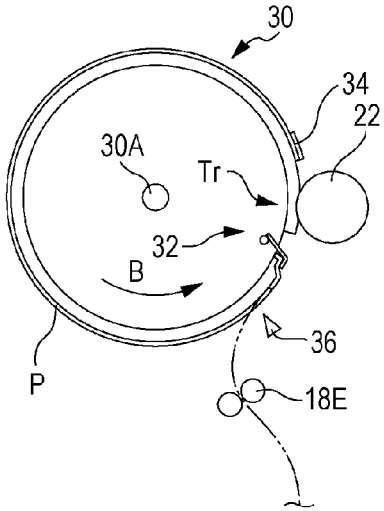

As illustrated in FIG. 8D, the trailing-end gripper 34 rotating together with the transfer drum 30 passes the transfer position Tr while controlling the trailing end portion of the sheet medium P.

Likewise, forming and developing of latent images for a second and subsequent colors (magenta and cyan, for example), which precede a final color (black, for example), and transferring of toner images corresponding to the latent images is repeated in accordance with the above-described procedure.

Figure 9A:
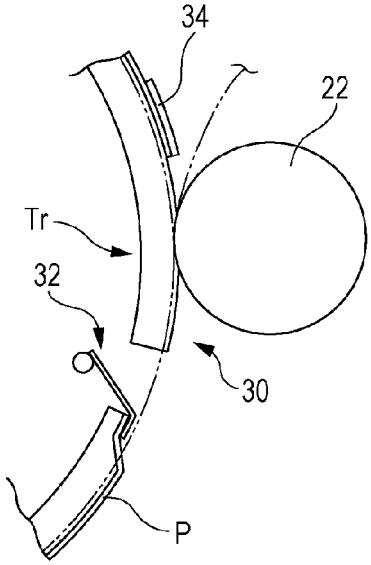
FIGS. 9A, 9B, 9C, and 9D illustrate a series of states in which a sheet medium P that has been wrapped around the transfer drum of the image forming apparatus according to the exemplary embodiment becomes separated from the transfer drum.
Figure 9B:
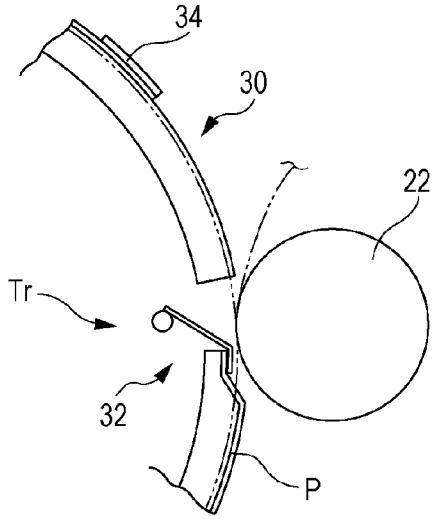
Figure 9C:
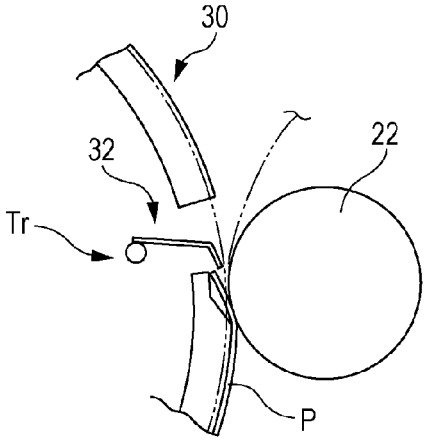

As illustrated in FIGS. 9A, 9B, and 9C, in the case of transferring a toner image of a final color (black, for example), the leading-end gripper 32 switches from the gripping state to the releasing state at the transfer position Tr, unlike in the case of transferring a toner image of a color that precedes the final color.

Figure 9D:
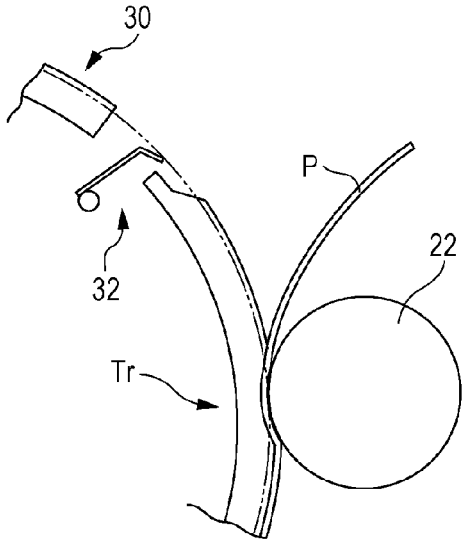

As illustrated in FIG. 9D, when the leading-end gripper 32 releases the leading end portion of the sheet medium P on which multiple toner images are formed, the leading end portion becomes separated from the transfer drum 30 due to having been nipped by the elastic layer 30C and the image carrier 22.

The sheet medium P whose leading end portion is separated from the transfer drum 30 is transported toward the fixing device 16 illustrated in FIG. 11.

As the sheet medium P is transported further, the trailing-end gripper 34 that controls the trailing end portion of the sheet medium P arrives at the stand-by position. At the stand-by position, the trailing-end gripper 34 switches from the controlling state to the releasing state to release the trailing end portion of the sheet medium P. The trailing-end gripper 34 that has switched to the releasing state stops at the stand-by position.

The toner images on the sheet medium P having been transported to the fixing device 16 are fixed onto the sheet medium P by the fixing device 16. As the sheet medium P is transported further, the sheet medium P becomes separated from the transfer drum 30. The sheet medium P is finally discharged to the discharge portion 42 by the discharging rollers 44.

Configuration of Related Portion

Now, a relationship between L1 and the length of each component will be described, where L1 denotes the peripheral length of the image carrier 22 from an exposure position Ro to the transfer position Tr.

Figure 2:
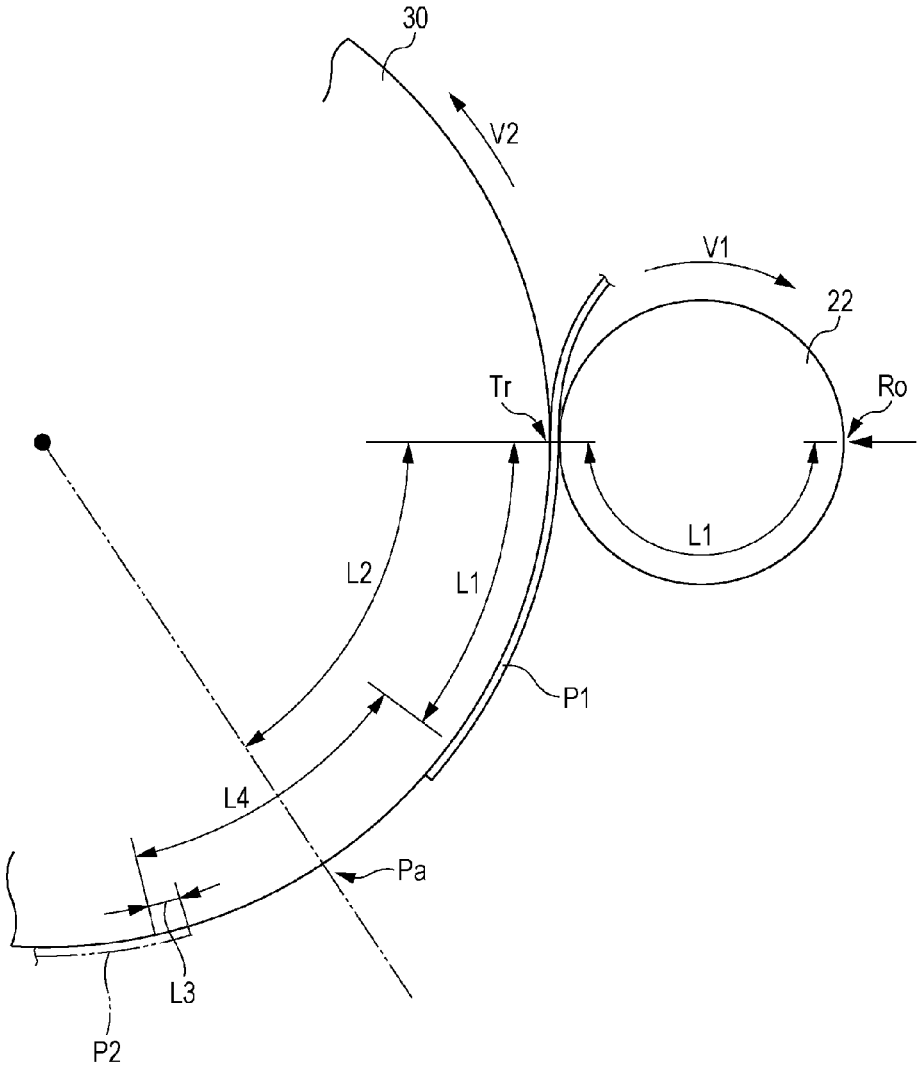
FIG. 2 is a schematic diagram illustrating the vicinity of the position at which the transfer drum and the image carrier of the image forming apparatus according to the exemplary embodiment perform nipping.

For easy understanding of the relationship between the lengths of components, FIGS. 1 and 2 schematically illustrate simple forms of the components and exclude unrelated components.

In FIGS. 1 and 2, a sheet medium P1 is a first sheet medium P that is firstly wrapped around the transfer drum 30 and to which first toner images are to be transferred. A sheet medium P2, on the other hand, is a sheet medium P that is wrapped around the transfer drum 30 after the sheet medium P1 has been wrapped and to which second toner images are to be transferred after all the first toner images are transferred to the sheet medium P1.

In FIG. 2, the sheet medium P2 (indicated by the two-dot chain line in FIG. 2) is located on a side that is further upstream than the gripping position Pa in the direction in which the sheet medium P is transported. Thus, the sheet medium P2 is not actually wrapped around the transfer drum 30 at this time. However, for easy understanding of the positional relationship between the sheet medium P1 and the sheet medium P2 on the transfer drum 30, the sheet medium P2 is illustrated by the two-dot chain line assuming that the sheet medium P2 is wrapped around the transfer drum 30.

In FIGS. 1 and 2, for easy comparison between the peripheral length of the transfer drum 30 and the peripheral length of the image carrier 22, these peripheral lengths are illustrated without considering the peripheral velocity of the image carrier 22, which is the peripheral velocity V1, and the peripheral velocity of the transfer drum 30, which is the peripheral velocity V2.

Each of the sheet media P1 and P2 is of a maximum size transportable by the transfer drum 30 (legal size, for example, in the exemplary embodiment).

The peripheral length of the transfer drum 30 from the gripping position Pa to the transfer position Tr is denoted by L2. The length of a leading-end margin on a leading-end side of the sheet medium P in which no toner image is formed is denoted by L3. The peripheral length of the transfer drum 30 from a limit position, up to which a toner image is formable, on the trailing-end side of the sheet medium P1 to a limit position, up to which a toner image is formable, on a leading-end side of the sheet medium P2 (this peripheral length is also referred to as an inter-image distance) is denoted by L4 (the distance between the sheet media+the leading-end margin+the trailing-end margin). The peripheral velocity of the image carrier 22 is denoted by the peripheral velocity V1, and the peripheral velocity of the transfer drum 30 is denoted by the peripheral velocity V2. Under the above conditions, the dimensions of components are determined such that the following inequalities (1) and (2) are satisfied:

$$(L1-L3)\times(V2/V1)<L2 \quad (1)$$

$$L2<(L1-L3+L4)\times(V2/V1) \quad (2)$$

The length of the leading-end margin on the leading-end side of the sheet medium P in which a toner image is not formed is a length between the limit position, up to which a toner image is formable, on the leading-end side of the sheet medium P and the leading end of the sheet medium P.

FIG. 3 illustrates examples of dimensions of the components with which the inequalities (1) and (2) are satisfied when, for example, the peripheral velocity V1 is 100.0 mm/s and the peripheral velocity V2 is 99.5 mm/s.

Operations of Configuration of Related Portion

FIG. 1 illustrates a state where an exposure for forming a toner image that is to be transferred to a sheet medium P1 is started, and FIG. 2 illustrates a state where the exposure for forming a toner image that is to be transferred to a sheet medium P1 is finished.

As illustrated in FIG. 1, when the inequality (1) is satisfied, the leading end of the sheet medium P1 arrives at a position that is L1−L3 away from the transfer position Tr at the time of starting an exposure for forming a first toner image that is to be transferred to a sheet medium P1 (at the exposure start). In other words, the leading end portion of the sheet medium P1 is gripped at this time (the leading end of the sheet medium P1 has passed the gripping position Pa). That is, the exposure is started after the leading end portion of the sheet medium P1 is gripped.

As illustrated in FIG. 2, when the inequality (2) is satisfied on the other hand, the leading end of the sheet medium P does not arrive at the gripping position Pa by the completion of the exposure. In other words, the exposure for forming a final toner image to be transferred to the sheet medium P1 is complete before the sheet medium P2 is gripped. That is, the exposure is finished before the leading end portion of the sheet medium P2 is gripped (completion of exposure).

As described above, when the configuration satisfies the inequalities (1) and (2), the exposure is started after the leading end portion of a first (preceding) sheet medium P1 is gripped, and the exposure is complete before the leading end portion of a second (subsequent) sheet medium P2 is gripped. In other words, while the exposure is performed, gripping of the leading end portion of the sheet medium P is not performed. This suppresses image defects due to vibration, which occurs through the gripping of the leading end portion of the sheet medium P, being transmitted to the exposure position Ro of the image carrier 22.

In the above case, a sheet medium P of a maximum size is taken into consideration. Accordingly, image defects due to vibration, which occurs through the gripping of the leading end portion of the sheet medium P, being transmitted to the exposure position Ro of the image carrier 22 are also prevented from occurring in sheet media P of any size.

Although the present invention has been described in detail on the basis of a specific exemplary embodiment, it is obvious to those skilled in the art that the present invention is not limited to the exemplary embodiment and that various other exemplary embodiments may be made within the scope of the invention. Although the positional relationships are described by taking the inequalities (1) and (2) as examples in the above exemplary embodiment, other configurations which are based on other formulae are also acceptable if the configurations consequently satisfy these inequalities (1) and (2).

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier, a surface of which is charged while the image carrier is rotating;

an exposing device that faces the image carrier at an exposure position and emits light toward the image carrier to form an electrostatic latent image on the charged surface of the image carrier;

a developing member that develops the electrostatic latent image formed on the surface of the image carrier into a toner image;

a transfer member that, while rotating, transports a recording medium to a transfer position, at which the transfer member faces the image carrier, and that transfers the toner image formed on the surface of the image carrier to the recording medium, the recording medium being wrapped around an outer peripheral surface of the transfer member; and a gripping member that is disposed on the transfer member, the gripping member gripping a leading end portion of the recording medium having been transported to the rotating transfer member at a gripping position, wherein the following inequalities (1) and (2) are satisfied:

$$(L1-L3)\times(V2/V1)<L2 \quad (1)$$

$$L2<(L1-L3+L4)\times(V2/V1) \quad (2)$$

where L1 denotes a peripheral length of the image carrier from the exposure position to the transfer position in a rotating direction of the image carrier, L2 denotes a peripheral length of the transfer member from the gripping position to the transfer position in the rotating direction of the transfer member, L3 denotes a length of a margin on a leading-end side of the recording medium in which no toner image is formed, L4 denotes a peripheral length of the transfer member, when a first recording medium and a second recording medium having a maximum size transportable by the transfer member are wrapped around the transfer member, between a trailing end of an image region of the first recording medium and a leading end of an image region of the second recording medium, the image regions of the recording media each being a region over the entire area of which an image is formable, the first recording medium being positioned on a side that is further upstream than the second recording medium in the rotating direction of the transfer member, V1 denotes a peripheral velocity of the image carrier, and V2 denotes a peripheral velocity of the transfer member.

2. The image forming apparatus according to claim 1, wherein V1 is greater than V2.

3. The image forming apparatus according to claim 1, wherein the exposing device starts emitting light after the gripping member has gripped the recording medium, and the exposure device stops emitting light before the gripping member grips a recording medium that is subsequently transported to the gripping position.

4. The image forming apparatus according to claim 1, wherein the transfer member transports the recording medium a plurality of times to the transfer position.

* * * * *